US005112190A

United States Patent [19]

Kajiwara et al.

[11] Patent Number: 5,112,190

[45] Date of Patent: May 12, 1992

[54] SHEET-METAL CENTRIFUGAL PUMP CASING

[75] Inventors: Kenichi Kajiwara, Kanagawa; Kikuichi Mori, Chiba; Hideo Ikeda; Shinichiro Arakawa, both of Kangawa, all of Japan

[73] Assignee: Ebara Corporation, Tokyo, Japan

[21] Appl. No.: 552,027

[22] Filed: Jul. 13, 1990

[30] Foreign Application Priority Data

Jul. 15, 1989 [JP] Japan ..... 1-183341
Apr. 20, 1990 [JP] Japan ..... 2-104542

[51] Int. Cl.[5] ..... F04D 29/42; F04D 29/44

[52] U.S. Cl. ..... 415/215.1; 415/206; 415/108

[58] Field of Search ..... 415/108, 172.1, 182.1, 415/196, 200, 202, 203, 128, 206, 213.1, 215.1

[56] References Cited

U.S. PATENT DOCUMENTS

| | | | |
|---|---|---|---|
| 786,922 | 4/1905 | Smith et al. | 415/200 |
| 2,347,386 | 4/1944 | Adams | 415/47 |
| 2,677,327 | 5/1954 | MacNeille et al. | 415/108 |
| 2,836,124 | 5/1958 | Lung | 415/182.1 |
| 2,844,100 | 7/1958 | Heinicke | 103/87 |
| 3,412,684 | 11/1968 | Lipe et al. | 103/114 |
| 3,826,589 | 7/1974 | Frank et al. | 415/201 |
| 4,245,952 | 1/1981 | Eberhardt | 415/170 |
| 4,717,311 | 1/1988 | Willette | 415/182.1 |
| 4,775,295 | 10/1988 | Starke et al. | 415/219 |
| 5,040,947 | 8/1991 | Kajiwara et al. | 415/206 |

FOREIGN PATENT DOCUMENTS

| | | | |
|---|---|---|---|
| 140542 | 12/1948 | Australia | 415/200 |
| 3517498C2 | 11/1986 | Fed. Rep. of Germany . | |
| 3517828A1 | 11/1986 | Fed. Rep. of Germany . | |
| 57-35676 | 8/1982 | Japan . | |
| 195496 | 8/1987 | Japan | 415/215.1 |

OTHER PUBLICATIONS

Patent Abstracts of Japan, vol. 12, No. 41 (M-666) [2888] Feb. 6, 1988.

*Primary Examiner*—Edward K. Look
*Assistant Examiner*—Michael S. Lee
*Attorney, Agent, or Firm*—Armstrong, Nikaido, Marmelstein, Kubovcik & Murray

[57] ABSTRACT

A sheet-metal centrifugal pump casing comprising a casing shell having a suction port and being formed of a steel plate by means of deep drawing using a press, and having a suction flange firmly attached to the suction port of the casing shell is disclosed. The centrifugal pump casing further comprises a partition body firmly attached to the inner surface of the casing shell for partitioning a space within the casing shell into a suction chamber and a pressure chamber, and a diffuser which is integrally extended from the suction side end portion of the partition body and which tapers off toward peripheral edge of said suction port so that an axial gap is formed between the end edge of the diffuser and the peripheral edge of said suction port.

Since the axial gap is formed between the end edge of the diffuser and the peripheral edge of the suction port, even in the case of the suction flange is acted upon by an external force such as by piping, a deformation does not affect the partition body, thus, problems such as contact between the partition body and the impeller may be completely avoided.

18 Claims, 7 Drawing Sheets

SHEET-METAL CENTRIFUGAL PUMP CASING

BACKGROUND OF THE INVENTION

1. Field of the Invention

The present invention relates to a sheet-metal centrifugal pump casing, and more particularly to a sheet-metal centrifugal pump casing which is capable of inhibiting deformation at the liner portion thereof, for example, even when an external force acts upon the suction flange.

2. Prior Art

In general, centrifugal pump casings made of sheet metals are known in which a casing shell having a suction port is formed from a stainless steel plate through a deep drawing process using a press and a suction flange is firmly attached to the suction port on the casing shell.

Centrifugal pump casings of this type tend to be lacking in strength because they are made of sheet metals, and, when the pump casing, for example, is subjected to an operating pressure, or internal pressure, i.e., the total pressure occurring as a result of centrifugal force of the impeller and the suction pressure acting on the suction side, or when the suction flange is acted upon by an external force due to piping, there is the possibility that these internal pressures and external forces will be transmitted to the pump casing and cause deformation of the liner portion thereof. When the liner portion is deformed, a contact spot occurs thereon with the impeller which causes problems such as noise and pump overload, and in extreme cases results in failure of the impeller due to contact between the casing shell and the impeller.

To prevent this, a configuration has been proposed such that, in addition to providing a portition body inside the casing shell which provides a partition between a suction chamber and a pressure chamber, a so-called flexible free structure is employed as part of said casing shell at the portion extending outwardly from such a partition body, whereby only a part of the casing shell is deformed because of such free structure when the external force due to piping as described above is applied so that such deformation does not reach the partition body.

Also, a configuration has been proposed such that a plurality of reinforcing members are securely extended between a suction flange and a casing shell to obtain a so-called rigid structure so that the external force due to piping acting upon the suction flange is directly transmitted to the casing shell where the external force due to piping may be absorbed by the casing shell itself.

However, there is a problem in the casing of the so-called flexible free structure that piping process becomes troublesome, because it is necessary to support the suction pipe with respect to the base structure by using another member while connecting the suction pipe to the suction flange.

Also, in the case of the so-called rigid structure, though no problems appear in normal use, deformation occurs at the liner portion of the casing shell leading to the problem of a contact spot as described above such as when the suction flange is subjected to an excessive external force which cannot be absorbed by the casing shell.

SUMMARY OF THE INVENTION

Accordingly, an object of the present invention is to provide a sheet-metal centrifugal pump casing in which the problems associated with the conventional arts as described above are eliminated so that deformation of the liner portion of the casing can be prevented even when the pump casing is subjected to an excessive external force.

To achieve the above mentioned object, in a centrifugal pump casing comprising a casing shell having a suction port and being formed of a steel plate by means of deep drawing using a press, and having a suction flange firmly attached to the suction port of the casing shell, the configuration of the present invention comprises a partition body disposed within the casing shell for partitioning a space within the casing shell into a suction chamber and a pressure chamber, and a diffuser which is integrally extended from the suction side end portion of the partition body and which tapers off toward peripheral edge of the suction port so that an axial gap is formed between the end edge of the diffuser and the peripheral edge of the suction port.

According to the present invention, even when the suction flange is acted upon by an external force due to piping through the suction pipe which is connected to the suction flange, such an external force due to piping is transmitted to a fixed flange mounted on such as a motor bracket through the pump casing shell and does not directly act upon a partition body and, therefore, deformation does not reach thereto. Also, since an axial gap is formed between the end edge of the diffuser and the peripheral edge of the suction port, the two edges do not come into contact with each other even if the suction flange is inclined by an external force due to piping, and thus the partition body is not deformed by this arrangement, too. In addition, since as described above an axial gap is formed between the end edge of the diffuser and the peripheral edge of the suction port, the two edges do not come into contact with each other even if the partition body is deformed in the axial direction due to internal pressure, and accordingly further deformation of the casing shell or the partition body is inhibited.

The above and other objects, features and advantages of the present invention will become more apparent from the following description when taken in conjuction with the accompanying drawings in which preferred embodiments of the present invention are shown by way of illustrative examples.

DESCRIPTION OF THE PREFERRED EMBODIMENTS

An embodiment of a sheet-metal centrifugal pump casing according to the present invention will be described below with reference to the accompanying drawings.

Figure 1:
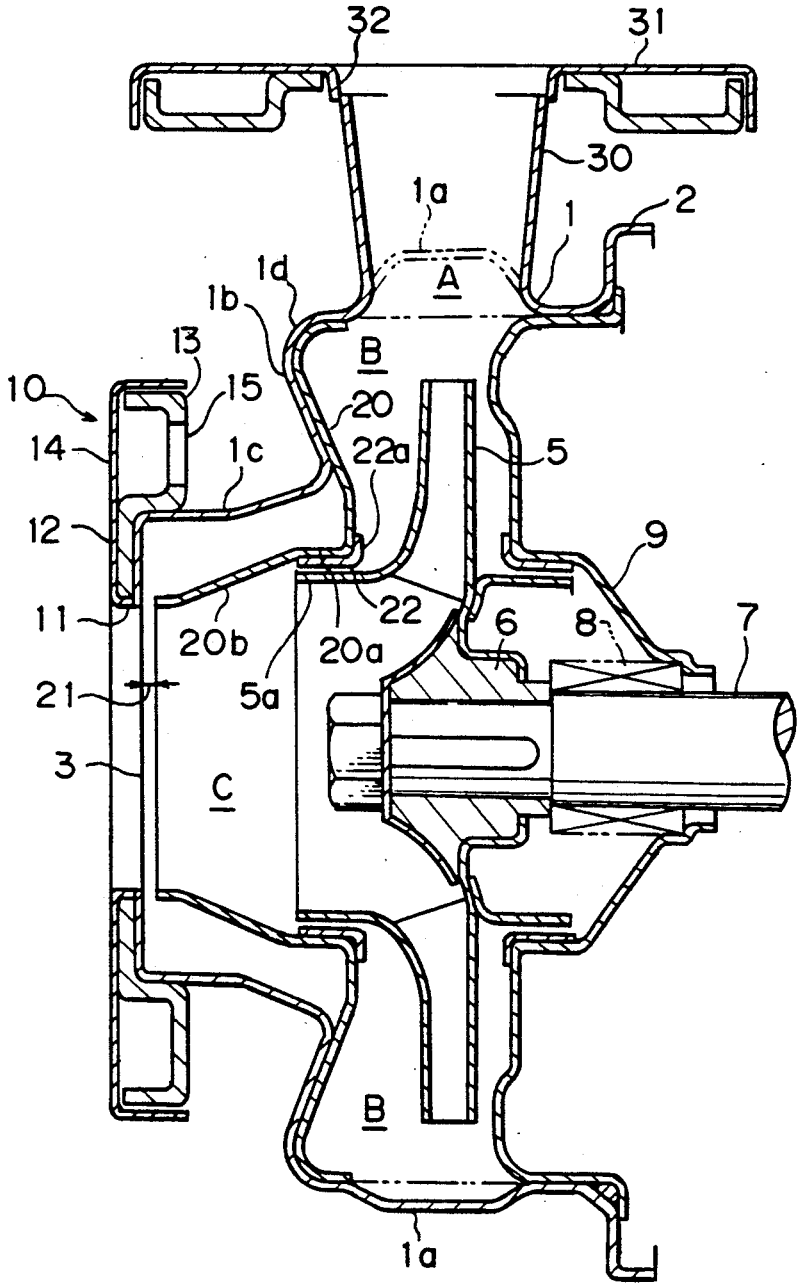
FIG. 1 is a longitudinal sectional view showing an embodiment of sheet-metal centrifugal pump casing according to the present invention.

Referring to FIG. 1, numeral 1 denotes a casing shell of a centrifugal pump, and the casing shell 1 is formed from a stainless steel plate with deep drawing by means of a press. A fixed flange 2 is integrally formed on one end of the casing shell 1, and this fixed flange 2 is coupled to a bracket (not shown) or the like of a motor. Further, a suction port 3 is formed at the other end of the casing shell 1.

Figures 3, 3A, 3B, 3C:
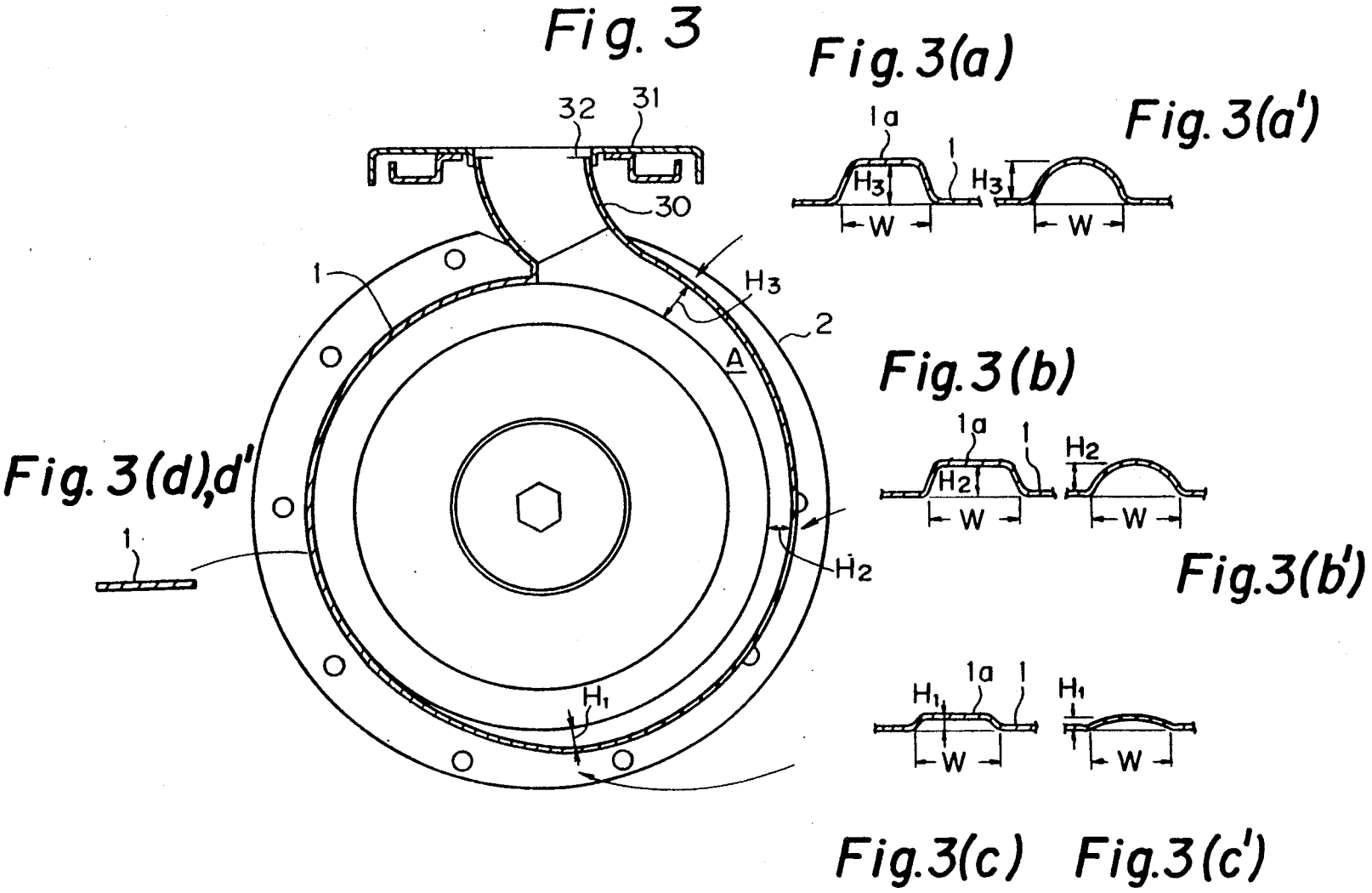
FIG. 3 is a transverse sectional view showing the same embodiment and in which FIGS. 3(*a*) to (*d*) are sections showing a one embodiment of a bulged portion at respective positions and FIGS. 3(*a'*) to (*d'*) are sections showing another embodiment of the bulged portion at respective positions.

A volute room A being extended in the circumferential direction is formed at the central portion inside the casing shell 1, and the periphery of the volute room A is bounded by a bulged portion 1*a* of the casing shell. This bulged portion 1*a* is formed such as by bulge forming by expanding the peripheral wall of the casing shell outwardly in the radial direction from a basic cylindrical surface. As shown in FIG. 3(*a*) to (*d*), the shape of the bulged portion 1*a* is formed to have substantially trapezoidal cross sections and the width W at the base side thereof is constant along the entire length, the expansion begins halfway along the periphery of the casing shell and the height $H_1$–$H_3$ of the bulged portion is gradually raised along the circumferential direction (counterclockwise as shown in the figure). By this configuration, the sectional area of the flow passage along the volute room A is gradually increased in the fluid flow direction.

The shape of this bulged portion may be formed to be substantially a circular arc in section as shown in FIGS. 3(*a*') to (*d*'). Since the so-called bulge forming is a forming process by which the bulged portion 1*a* is caused to expand by applying pressure from the inside to a piece of steel plate, if it is formed into a circular arc, the bulged portion 1*a* may be formed to have an uniform thickness comparing to that formed into a trapezoid, because it is not necessary to form two corners at the upper side of the section, and as a result the strength of the casing shell 1 may be increased. Further, the bulged forming machine may be of a smaller type, because a circular arc may be formed with the application of a smaller internal pressure.

An impeller 5 is located inside the casing shell 1, the impeller 5 is integrally assembled with a boss 6, and the boss 6 is coupled to the free end of a main shaft 7. A shaft sealing device 8 is mounted on the main shaft 7, and the shaft sealing device 8 is supported by a casing cover 9 which is firmly affixed to the casing shell 1.

The wall of the casing shell 1 at the suction side consists of a first wall portion 1*b* and a second wall portion 1*c* which are integrally formed with each other, and the first wall portion 1*b* is caused to protrude outwardly at its shoulder portion 1*d* to have a substantially S-shaped cross section for the purpose of increasing its rigidity while the second wall portion 1*c* is formed to have a substantially L-shaped cross section. On the outside of the second wall portion 1*c*, a suction flange 10 having been formed as a separate member by means of a press is connected by welding, and a suction opening 11 which is in communication with said suction port 3 is opened at the central portion of the suction flange 10.

A sealing surface 12 is formed on the suction flange 10 for the connection to a corresponding flange (not shown), and a reinforcing flange 13 is firmly affixed to the reverse side of the sealing surface 12. Four boltholes 14 are preforated on said suction flange 10, and, as can be seen from FIG. 2, four through holes 15 are provided in said reinforcing flange 13 so as to correspond in position to said boltholes 14.

Also, a partition body 20 having a substantially S-shaped cross section is firmly attached to the inner surface of the first wall portion 1*b* of the casing shell 1, the partition body 20 integrally includes a cylindrical partitioning portion 20*a*, and diffuser 20*b* which tapers off toward the side of suction port 3 is integrally extended from the partitioning portion 20*a*. The diameter of the end portion at the suction side of the diffuser 20*b* is substantially the same as the diameter of the suction port 3, and a small gap 21 in the axial direction is formed between the end edge of the diffuser 20*b* and the peripheral edge of said suction port 3. Further, a liner ring 22 having a substantially L-shaped cross section is force-fitted into the inner peripheral of the partitioning portion 20*a* such that its collar portion 22*a* abuts against the partition body 20, and an end portion 5*a* of said impeller 5 is fitted with a play into the inner peripheral of the liner ring 22. The gap at the portion with a play is kept small so that water, raised in pressure by the impeller 5, does not flow back to the suction side, i.e., it constitutes the liner ring clearance. Pressure chamber B and suction chamber C are thus separated by the liner ring 22 of said partitioning portion 20*a*.

Figure 2:
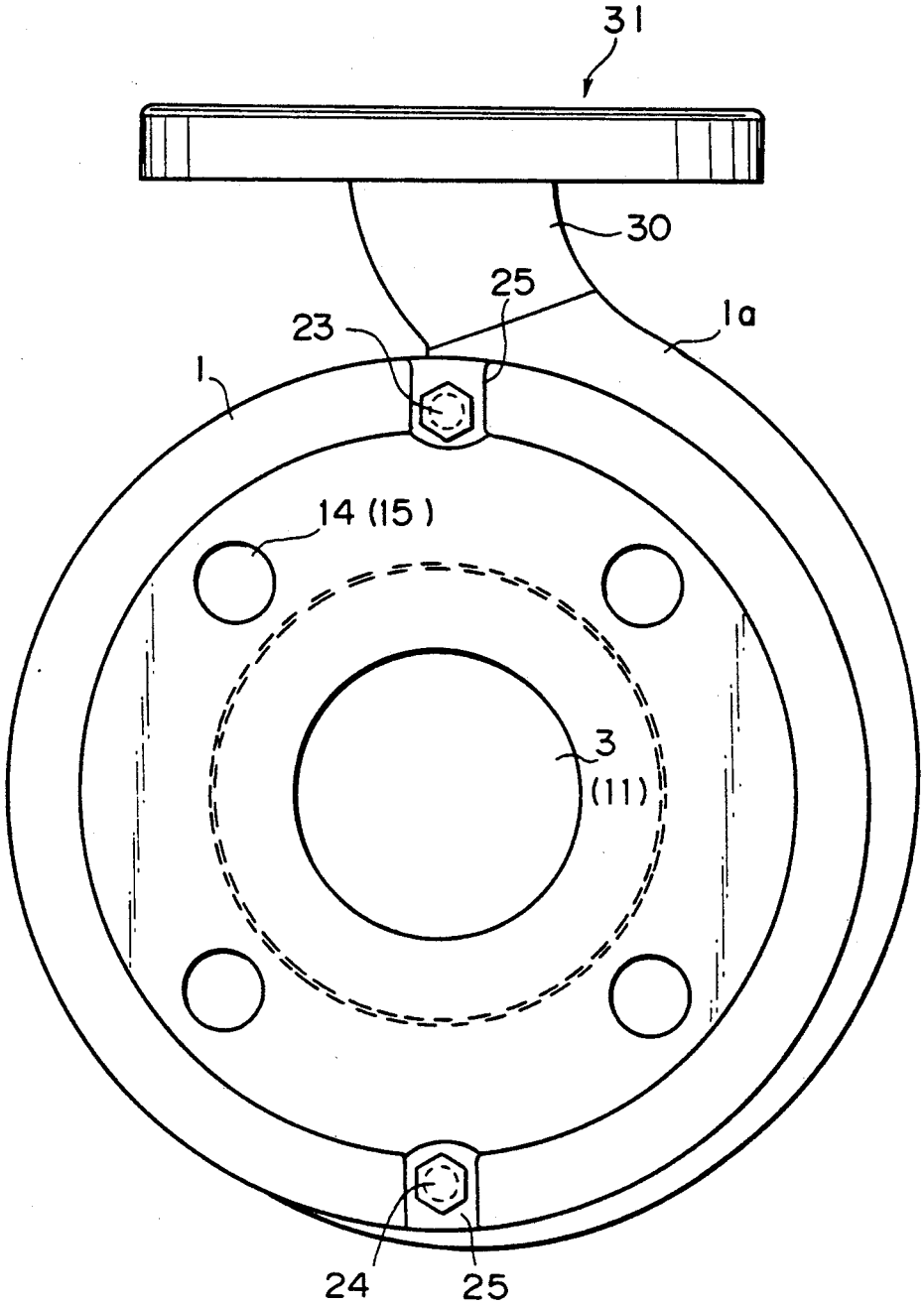
FIG. 2 is a front view showing the same embodiment.
Figure 4:
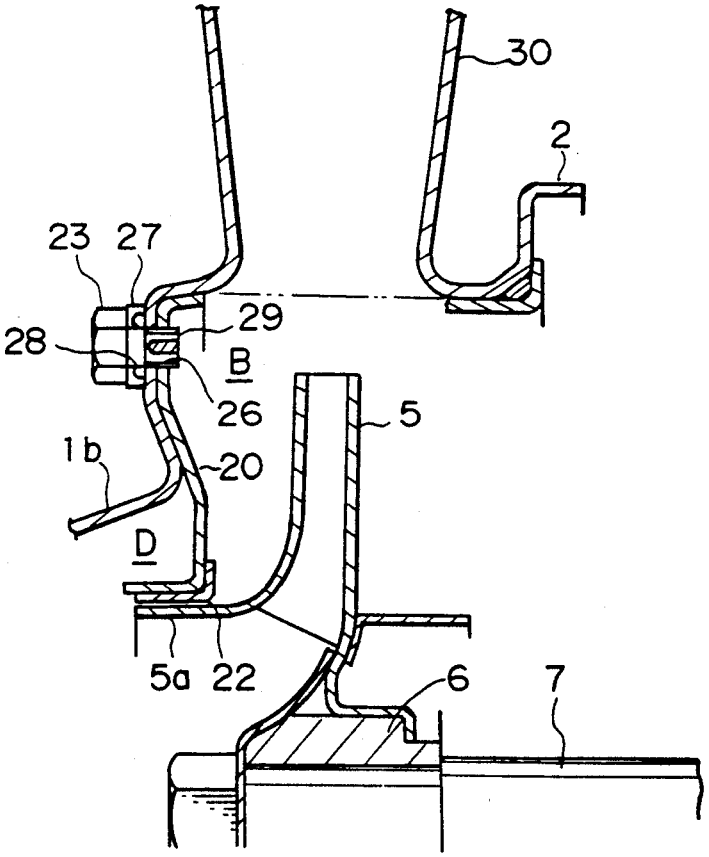
FIG. 4 is a partial sectional view showing the construction of the plug attaching portion of the same embodiment.

Plugs 23, 24 , are attached to upper and lower portions of the casing shell 1 as shown in FIG. 2, and the upper plug 23 is used as an air extractor while the lower plug 24 is used for draining. Part of a shoulder portion 1*d* of the casing shell 1 is made flat and these plugs 23, 24 are attached to those flat portions 25. At the flat portions 25, female screw holes 26 are formed through the first wall portion 1*b* and the partition body 20 as shown in FIG. 4, and the plugs 23, 24 are threaded into the female screw holes 26 via a distance rings 27. O-rings 28 are attached on the inner surface of the distance rings 27, so that O-rings 28 are deformed to prevent fluid leakage when the plugs 23, 24 are tightened. Further, longitudinally extended grooves 29 are formed on the periphery of the stems of the plugs 23, 24 so that air extraction or drainage can be performed through the grooves 29 without completely removing the plugs 23, 24, i.e., can be performed in the condition where they are partially loosened.

Furthermore, as can be seen from FIG. 2 and FIG. 3, an end of a nozzle 30 is connected to the highest part of the bulged portion 1*a* of the casing shell 1, i.e., to the outermost end position of the bulged portion 1*a* so that the internal flow passage may be smoothly continues thereinto. A discharge flange 31 is connected to the other end of the nozzle 30, and a discharge opening 32 is provided at the central portion of the discharge flange 31. Since the structure of the discharge flange 31 is identical to that of the suction flange 10, description thereof is omitted.

Operation of a centrifugal pump according to the present embodiment will now be described.

When rotating a driving motor (not shown) which has been coupled to the main shaft 7, the impeller 5 is integrally rotated and a fluid is sucked from the suction port 3. The sucked fluid passes through the internal portion of the impeller 5 and is imparted with a centrifugal force so as to be discharged into the volute room A from the peripheral portion thereof. Thus released fluid is removed circumferentially (counterclockwise as shown in FIG. 2) within the volute room A and is discharged from the discharge opening 32 of the discharge flange 31 via the nozzle 30.

According to the present embodiment, even when an external force such as that due to piping acts upon the suction flange 10, such an external force is trasmitted to the fixed flange 2 through the second wall portion 1*c* and the first wall portion 1*b* of the casing shell 1 and is not directly transmitted to the partition body 20. Accordingly, even when deformation of the suction flange 10 is caused by the action of an external force, any such deformation does not affect the partitioning portion 20*a* of the partition body 20 and, therefore, contact between the liner ring 22 and the end portion 5*a* of the impeller 5 is avoided. Since, furthermore, the axial gap 21 is formed between the end edge of the diffuser 20*b* and the peripheral edge of said suction port 3, contact does not occur between the end edge of the diffuser 20*b* and the peripheral edge of said suction port 3 even in cases such as of inclining of the suction flange 10; a deformation, therefore, may securely be avoided also in this way at the partitioning portion 20*a* of the partition body 20.

In addition, according to the present invention, since the volute room A, of which the width W at the base side is kept constant while the bulged height H is gradually increased in a circumferential direction, is formed at the central portion of the casing shell 1, a fluid being discharged from the peripheral portion of the impeller 5 may smoothly flow into the volute room A thereby improving the hydraulic efficiency. Further, since the diffuser 20*b* is integrally extended from the partitioning portion 20*a* of the partition body 20 and an end portion of this diffuser 20*b* is extended almost as far as the peripheral edge of the suction port 3, the fluid may flow smoothly thereby enabling a further improvement in hydraulic efficiency. It should be noted that, if the shape of the bulged portion 1*a* is formed to have cross sections that are substantially circular arcs as shown in (*a'*) to (*d'*) in FIG. 3, the hydraulic efficiency may be improved even further as compared to that of trapezoids, because the contact area with the fluid (so-called wet area) may be reduced.

Also, the rigidity of the casing shell 1 may be significantly increased, because the first wall portion 1*b* of the casing shell 1 is caused to protrude outwardly at its shoulder portion 1*d* so as to have a substantially S-shaped cross section. Moreover, air extraction or draining, may be carried out by only slightly loosening the plugs 23, 24 without fully pulling them out. Further, as can be seen from FIG. 4, when air is extracted at the time of starting up the pump, not only the air in the pressure chamber B but also the air in the empty portion D is simultaneously extracted by slightly loosening the upper plug 23. Air within this empty portion D escapes to the outside through the gap between the first wall portion 1*b* and the partition body 20 and then through the groove 29 at the peripheral portion of the stem of the plug 23. Note that, by loosening the lower plug 24, it is possible to similarly effect drainage after stopping the pump.

Figure 5:
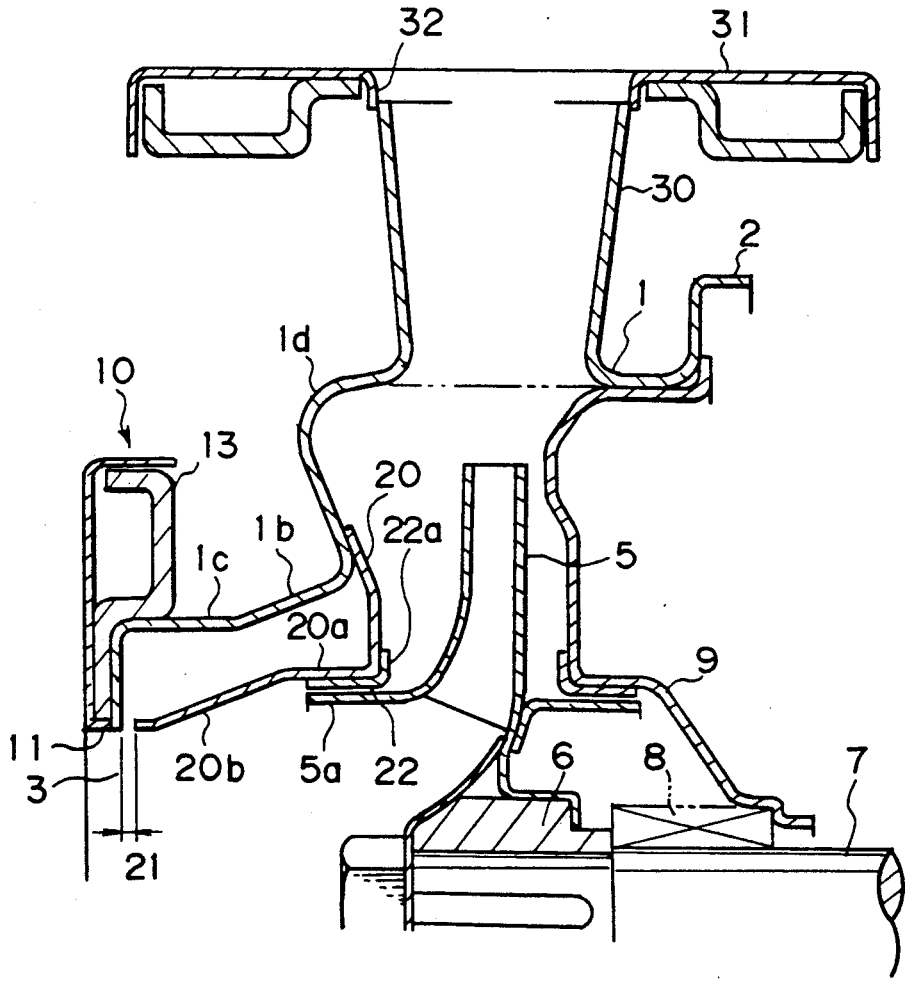
FIG. 5 is a sectional view showing another embodiment of the invention.

FIG. 5 shows another embodiment of the invention. According to this embodiment the partition body 20 is formed to have a smaller outer diameter, and the peripheral edge of the partition body 20 is firmly fixed to the lower area of the first wall portion 1*b*. The material costs may be reduced by this configuration. Although, it is somewhat inadequate from the viewpoint of reinforcement of the casing shell 1, since it is not necessary to reinforce the casing shell 1 to any great extent in a low pump in which a deformation due to internal pump pressure is less likely, this embodiment may be suitably incorporated into a low lift pump.

Figure 6:
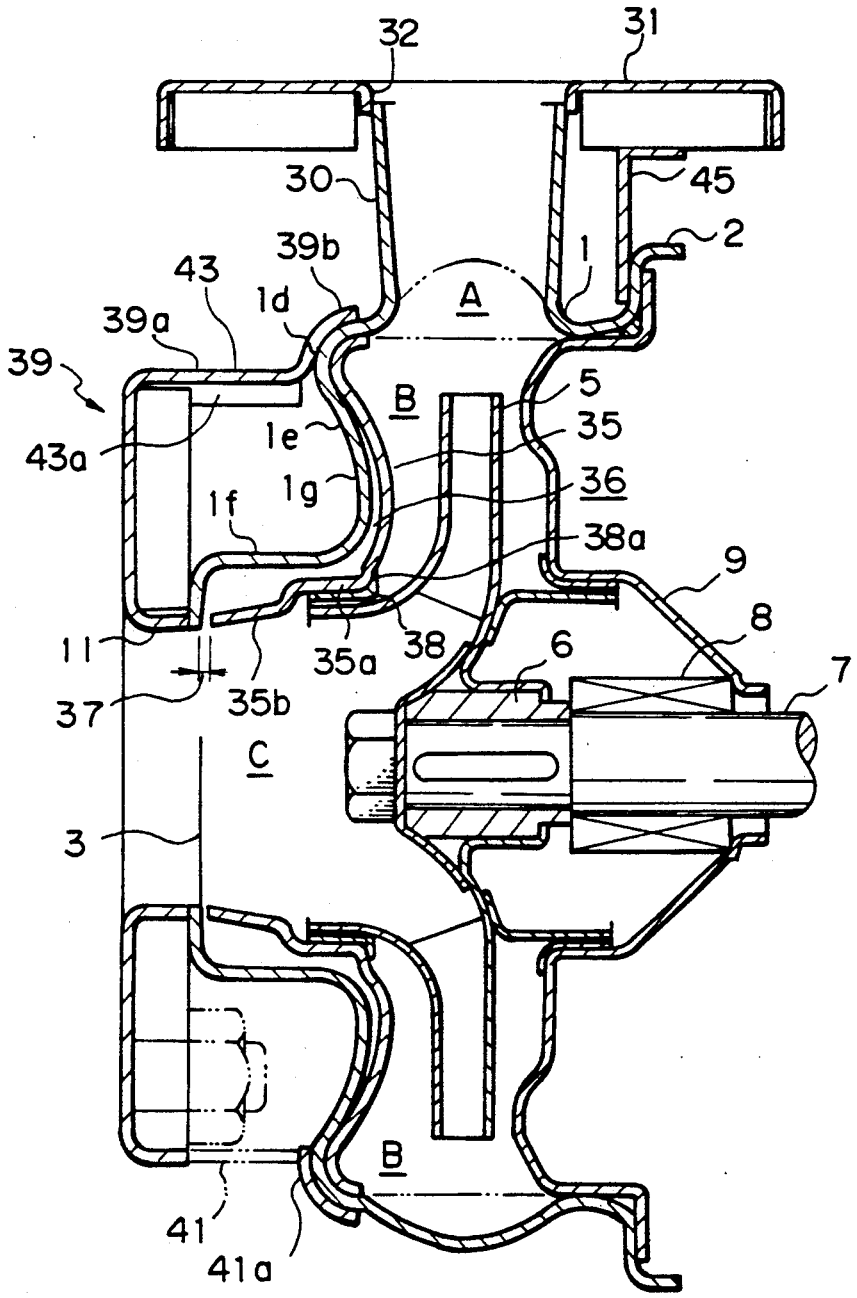
FIG. 6 is a sectional view showing still another embodiment of the invention.
Figure 7:
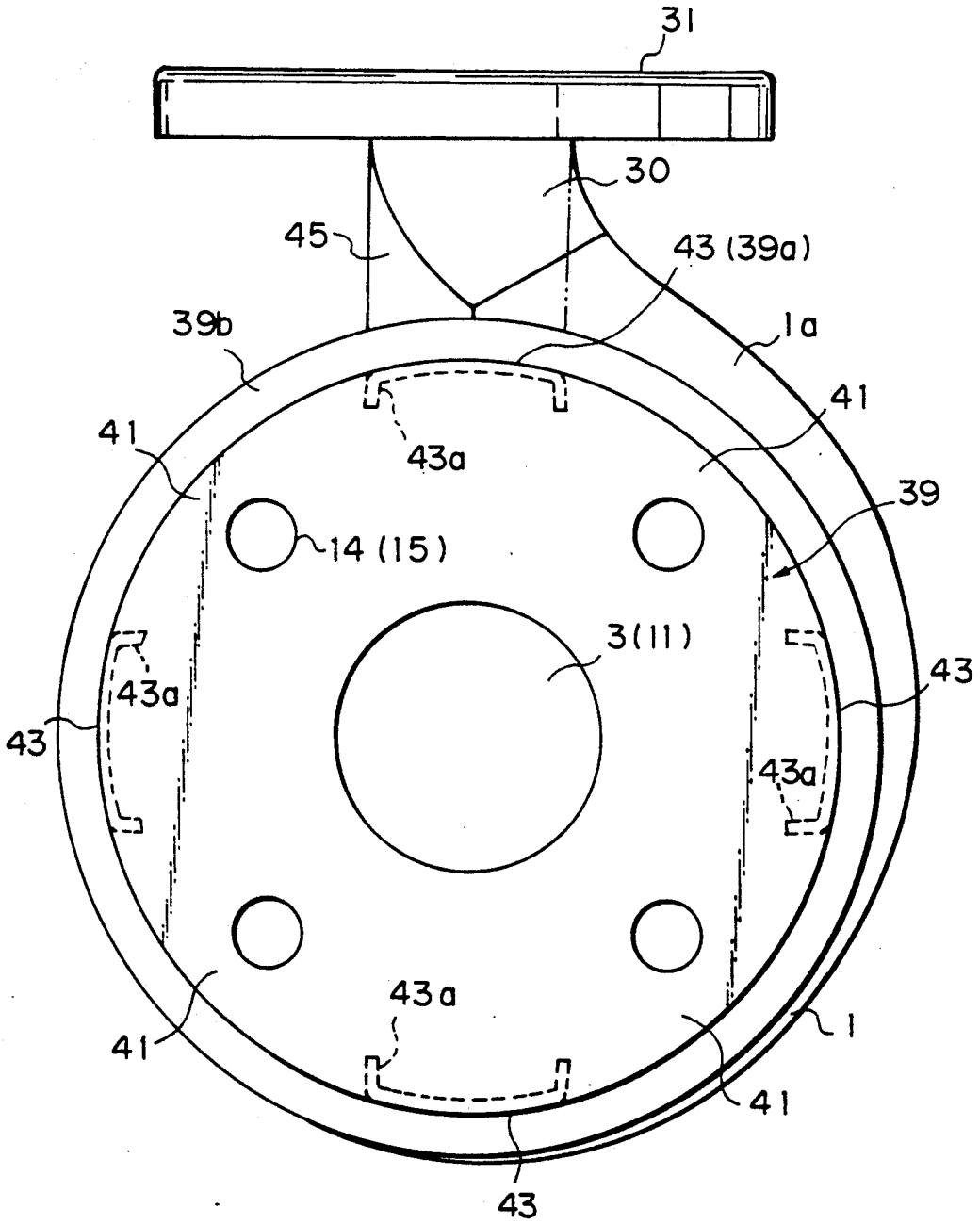
FIG. 7 is a front view of the last embodiment.

FIG. 6 and FIG. 7 show still another embodiment of the present invention.

In this embodiment, the suction side wall of a casing shell 1 consists of a first wall portion 1*e* and a second wall portion 1*f* which are formed integrally with each other. The first wall portion 1*e* is protruded outwardly at its shoulder portion 1*d* and is reversely curved in a concave configuration at the remaining portion 1*g* thereof, and the second wall portion 1*f* is formed to have a substantially L-shaped cross section and a suction port 3 is opened at the end thereof. Further, partition body 35 having substantially S-shaped cross sections is located inside the first wall portion 1*e* of the casing shell 1, and this partition body 35 is firmly attached to the inner surface of the first wall portion 1*e* only at its peripheral edge and the remaining portion of the partition body 35 is supported thereby with a space 36 provided between itself and the remaining portion 1*g* of the first portion 1*e*. Furthermore, the partition body 35 is integrally provided with a partitioning portion 35*a*, and a diffuser 35*b* which tapers off toward the suction port 3 is integrally extended from this partitioning portion 35*a*.

The diameter of this diffusion 35*b* at its suction side end portion is substantially the same as that of the suction port 3, and a small gap 37 in the axial direction is formed between the end edge of the diffuser 35*b* and the peripheral edge of the suction port 3. Further, a liner ring 38 being formed to have generally L-shaped cross sections is press-fitted into the inner peripheral of the cylindrical partitioning portion 35*a* so that its collar 38*a* abuts against the partition body 35, and an end portion 5*a* of the impeller 5 is fitted with play into the inner peripheral of the liner ring 38. The gap at the portion fitted with a play is kept small so that water, raised in pressure by the imprller 5, does not flow back to the suction side, i.e., it constitutes the liner ring clearance. Pressure chamber B and suction chamber C are thus parted by the liner ring 38 of said partitioning portion 35*a*.

Moreover, a suction flange 39 having been press-formed as a separate member is welded to the end portion of the second wall portion 1*f*. Outer peripheral portion 39*a* of the suction flange 39 is extended cylindrically toward the first wall portion 1*e*, and this peripheral portion 39*a* has a ring-like end edge portion 39*b*which engages the outer surface of the shoulder portion 1*d* of the first wall portion 1*e* and which is welded thereto. Also, wide windows 41 are opened at four places around the outer peripheral portion 39*a* as shown in FIG. 7, and the remaining portion of the outer peripheral portion 39*a* constitutes a support portion 43 for supporting the suction flange 39. The windows 41 provide working space for inserting tools at the time of attaching the suction flange 39 by means of bolts and nuts (shown by an imaginary line) to a corresponding flange (not shown). It should be noted that end edge portions 41*a* at the outer end bounding the windows 41 and both side edge portions 43*a* of the remaining support portions 43 are inwardly bent to a small extent respectively, for the purpose of reinforcement.

Operation of the present embodiment will now be described.

Since the first wall portion 1e is formed such that its shoulder portion 1d is protruded outwardly and the remaining portion 1g is reversely curved into a concave mirror-like configuration and the outer peripheral edge of the partition body 35 is firmly attached to the inner surface of the shoulder portion 1d, the rigidity of the casing shell 1 may be sufficiently improved. Also, since a space 36 is provided between the concave-mirror-like portion 1g of the first wall portion 1e and the partition body 35 and the pressure in this space 36 becomes equal to the pressure in the suction chamber C, the pressure due to the centrifugal force of the impeller 5 acts only upon the partition body 35 while the concave mirror-like portion 1g is acted upon only by the suction pressure that is applied to the suction side; accordingly, deformation of the casing shell 1 may be reduced, because the pump casing shell is not acted upon by the total operating pressure, which is constituted of the total pressure caused by the centrifugal action and the suction pressure, at once.

As a result, though a portion of the internal pressure acts upon the partition body 35, even if the partition body 35 is deformed in the axial direction due to internal pressure, such a deforming force is not transmitted to the vicinity of the suction port 3, because the axial gap 37 is formed between the end edge of the diffuser 35b and the peripheral edge of the suction port 3. Thus deformation of the casing shell 1 is prevented.

Furthermore, since, four support portions 43 remain at the peripheral portion 39a of the suction flange 39, and a ring-like end edge portion 39b located at the end of the support portions 43 is welded to the outer surface of the shoulder portion 1d of the first wall portion 1e, the rigidity becomes significantly higher at the suction side of the casing shell 1, thus deformation of the casing shell 1 due to internal pressure may be avoided.

Moreover, because of the fact that the support portions 43 are remained at the peripheral portion 39a of the suction flange 39, sufficient rigidity is ensured for the support of the suction flange 39 and, therefore, inclining of the suction flange 39 may be prevented. Also, even when the suction flange 39 is acted upon, for example by an excessive piping force which results in an inclining of the suction flange 39, only the casing shell 1 is caused to deform and such deforming force is not transmitted to the partition body 35 because the axial gap 37 is formed at the distal end of the diffuser 35b; a liner ring clearance is therefore properly maintained and contact between the liner ring and the impeller does not occur. Further, since both of the side edge portions 43a of a support portion 43 are bent inwardly, a high degree of rigidity is provided. Since the support portions 43 are not to be disposed at positions that may come into contact with a working fluid, a low cost steel plate or the like may be used as the material therefor instead of a high cost material such as stainless steel or the like.

Moreover, in order to increase the rigidity of the discharge 31, a sheet like discharge flange support body 45 is extended over the discharge flange 31 and the fixed flange 2 of the casing shell 1. By this configuration, when the discharge flange 31 is acted upon by an external force, it is not deformed because such a force is supported by the discharge flange support body 45. Furthermore, even if the discharge flange 31 is in some way deformed, only the casing shell 1 is deformed and such a deforming force does not reach the partition body 35 because the axial gap 37 is formed at the distal end of the diffuser 35b in a similar manner to that described above; the liner ring clearance may therefore be properly maintained and contact thereat does not occur.

What is claimed is:

1. A sheet-metal centrifugal pump casing comprising a casing shell having a suction port and being formed of a steel plate by means of deep drawing using a press, and a suction flange firmly attached to the suction port of the casing shell, said centrifugal pump casing further comprising a partition body firmly attached to an inner surface of said casing shell for partitioning a space within said casing shell into a suction chamber and a pressure chamber, and a diffuser which is integrally extended from the suction side end portion of the partition body and which tapers off toward peripheral edge of said suction port so that an axial gap is formed between the end edge of the diffuser and the peripheral edge of said suction port.

2. A sheet-metal centrifugal pump casing of claim 1, wherein a volute room providing a flow passage is extended in a circumferential direction inside the casing shell, the periphery of said volute room is defined by a bulge-formed portion formed by bulging a peripheral wall of said casing shell outwardly in a radial direction, the sectional area of said volute room is gradually increased toward the fluid flow direction of the pump.

3. A sheet-metal centrifugal pump casing of claim 2, wherein said bulged portion is formed to have substantially trapezoidal cross section.

4. A sheet-metal centrifugal pump casing of claim 2, wherein said bulged portion is formed to have a substantially circular arc cross section.

5. A sheet-metal centrifugal pump casing of claim 1, wherein the suction side of said casing shell consists of a first wall portion and a second wall portion which are integrally formed with each other, said first wall portion is protruded outwardly at a shoulder portion therefor to have a substantially S-shaped cross section, while said second wall portion is formed to have a substantially L-shaped cross section.

6. A sheet-metal centrifugal pump casing of claim 1, wherein said partition body includes a cylindrical partitioning portion integrally formed therewith, and said diffuser is integrally extended from said partitioning portion.

7. A sheet-metal centrifugal pump casing of claim 6, wherein a liner ring having a substantially L-shaped cross section is force-fitted into the inner peripheral of said partitioning portion, and an end portion of said impeller is fitted with a play into the inner peripheral of said liner ring.

8. A sheet-metal centrifugal pump casing of claim 1, wherein the diameter at the end edge of said diffuser is substantially the same as the diameter at the peripheral edge of said suction port.

9. A sheet-metal centrifugal pump casing according to any one of claims 1 to 8, wherein only the peripheral edge portion of said partition body is firmly attached to the inner surface of said casing shell, with the rest of said partition body being supported with a space provided between itself and the inner surface of said casing shell.

10. A sheet-metal centrifugal pump casing of claim 9, wherein said space is in communication with said suction chamber through said axial gap between the end edge of said diffuser and the peripheral edge of said suction port.

11. A sheet-metal centrifugal pump casing of claim 1, wherein an air extraction plug for extracting air from said suction chamber and said pressure chamber is attached to an upper portion of said casing shell, and a drain plug for draining said suction chamber and said pressure chamber is attached to a lower portion of said casing shell.

12. A sheet-metal centrifugal pump casing of claim 11, wherein a part of a shoulder portion of said casing shell is made flat at the upper and lower portions thereof, and said plugs are attached to said flat portions.

13. A sheet-metal centrifugal pump casing of claim 12, wherein female screw holes are formed through a wall of said casing shell and said partition body at said flat portions, and said plugs are threaded into said female screw holes.

14. A sheet-metal centrifugal pump casing of claim 13, wherein a longitudinally extended groove is formed on the periphery of the stem portion of said each plug.

15. A sheet-metal centrifugal pump casing of claim 1, wherein the suction side of said casing shell consists of a first wall portion and a second wall portion which are integrally formed with each other, said first wall portion is protruded outwardly at shoulder portion thereof and is reversely curved in a concave configuration at the remaining portion thereof, while said second wall portion is formed to have a substantially L-shaped cross section.

16. A sheet-metal centrifugal pump casing of claim 15, wherein said partition body has substantially S-shaped cross section and is firmly attached to the inner surface of said first wall portion only at peripheral edge portion thereof, whereby said partition body is supported with a space formed between itself and the remaining portion of said casing shell.

17. A sheet-metal centrifugal pump casing of claim 16, wherein outer peripheral portion of said suction flange is extended cylindrically toward the suction side surface of said first wall portion of said casing shell, said peripheral portion has a ring-like end edge portion which engages and is welded to the outer surface of said first wall portion.

18. A sheet-metal centrifugal pump casing of claim 17, wherein wide windows are opened around said outer peripheral portion of said suction flange for providing working space therein, and the remaining portion of said outer peripheral portion provides a support portion for supporting said suction flange.

* * * * *